United States Patent [19]

Zago

[11] Patent Number: 4,573,222

[45] Date of Patent: Mar. 4, 1986

[54] CRASH HELMET

[76] Inventor: Giovanni Zago, via N. Aprilis, 41, 33080 San Quirino, Italy

[21] Appl. No.: 591,085

[22] Filed: Mar. 19, 1984

[30] Foreign Application Priority Data

Mar. 30, 1983 [IT] Italy ..... 41544 A/83

[51] Int. Cl.[4] ..... A42B 1/08

[52] U.S. Cl. ..... 2/424; 2/410; 2/425

[58] Field of Search ..... 2/424, 425, 410, 411, 2/412, 415, 9

[56] References Cited

FOREIGN PATENT DOCUMENTS

| | | | |
|---|---|---|---|
| 3143796 | 5/1983 | Fed. Rep. of Germany | 2/410 |
| WO83/00605 | 3/1983 | PCT Int'l Appl. | 2/410 |
| 2087712 | 6/1982 | United Kingdom | 2/425 |

*Primary Examiner*—Werner H. Schroeder
*Assistant Examiner*—Judith L. K. Olds
*Attorney, Agent, or Firm*—Guido Modiano; Albert Josif

[57] ABSTRACT

A crash helmet including a head cap and visor combined with a lower element configured substantially as a padded split ring. Said ring is attached to the rear portion of the head cap and can be deformed elastically at lateral regions thereof to define an openable entry for putting the helmet on and off.

6 Claims, 6 Drawing Figures

CRASH HELMET

BACKGROUND OF THE INVENTION

This invention relates to a crash helmet of the type including component parts forming the helmet assembly, which sometimes is called of wrap-a-round or integral type.

Such crash helmets, as used by motorcyclists, car drivers, skiers, etc., conventionally comprise a rigid cap open at the bottom for introducing one's head thereinto.

To secure the helmet to the user's head, several techniques have been adopted which comprise either chin straps with a buckle or indeformable elements associated with the cap by means of hinge connections and adapted to be spread apart to let the user's head in and then brought together and secured with some locking device.

Such prior techniques are not devoid of disadvantages, and sometimes are quite expensive to manufacture.

In fact, the chin strap may even constitute a potential risk because, owing to its obviously small width, it can only span a limited area under one's chin.

The spread-apart elements hinge connected to the helmet cap involve complex and expensive parts and manufacturing procedures.

SUMMARY OF THE INVENTION

It is an object of this invention to provide a crash helmet which can obviate the problems encountered with currently available helmets.

A further object of the invention is to provide a crash helmet which can be secured once it has been put on by the user without any chin strap.

It is another object of this invention to provide a crash helmet having spread-apart parts which involve no hinged connections.

Still another object of the invention is to provide a crash helmet which incorporates a reliable closure arrangement which is simple to manufacture and convenient to use.

These and other objects, such as will become apparent hereinafter, are achieved by a crash helmet, characterized in that it comprises a rigid head cap having a tilt-up visor, said head cap being completely open at the bottom where it is only partially closed by a padded split ring elastic element, said split ring being deformable elastically, associated rearwardly to the helmet head cap, and engaging forward with its free ends at the split region in a detent on the helmet head cap chin piece.

BRIEF DESCRIPTION OF THE DRAWINGS

Further features and advantages of the invention will be more readily understood from the following detailed description of a preferred embodiment thereof, given here by way of example only with reference to the accompanying illustrative drawings, where.

DESCRIPTION OF THE PREFERRED EMBODIMENTS

Figure 1:
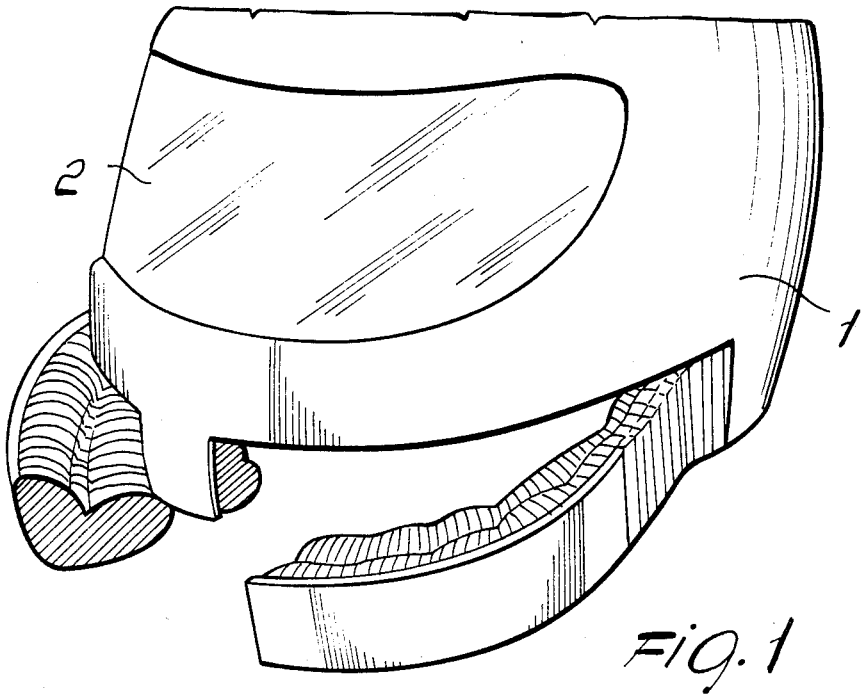
FIG. 1 is a perspective view of the crash helmet of this invention showing its openable parts.

Making reference to the drawing views, the crash helmet of this invention comprises a head cap or shell 1 formed from a rigid material exhibiting good impact strength and having at the front an opening covered with a movable transparent visor 2.

The bottom or base of the cap 1 is completely open, and the cap has an L-like contoured nape base portion 3 depending therefrom around the nape of the neck and a substantially middle-located front base portion 5 with a lug 4 made rigid with the portion 5 encircling the bottom region of the opening covered by the visor 2.

The helmet shell has two opposite side base portions which define open lateral areas or recesses 6 which extend through an arc from the front base portion back to the nape base portion 3 nearly at the nape of the neck.

Of course, the head cap or shell 1 is suitably padded with a shock absorbing material on its inside.

Figure 3:
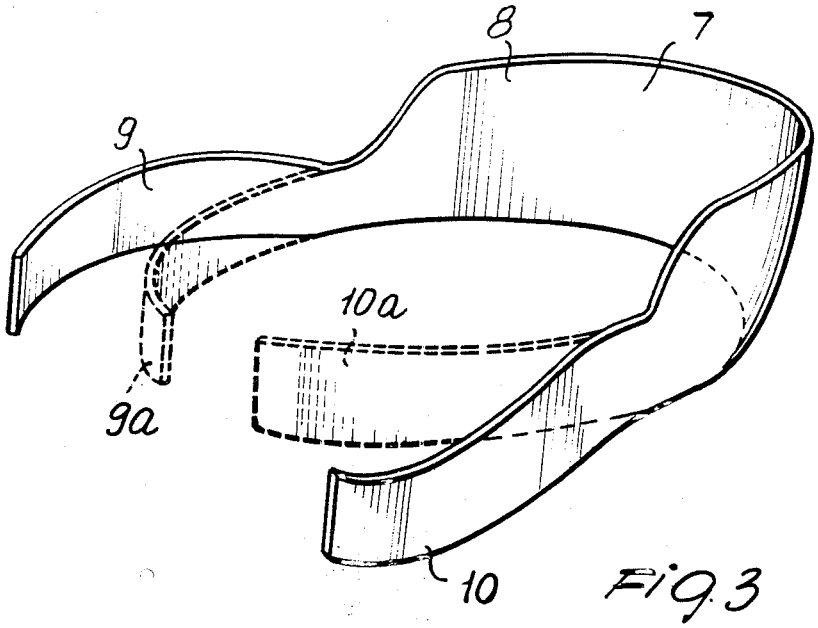
FIG. 3 shows simultaneously the split ring in two different positions thereof.

The crash helmet is completed by a resilient split metal ring, indicated at 7, which comprises essentially a bent resilient metal lamina having a nape facing section indicated at 8 to be arranged at the nape base portion of the cap 1 spanning the nape of the neck and two arculated appendages or jaw facing sections 9 and 10 which can assume elastically the positions 9*a* and 10*a*, shown in dotted lines in FIG. 3, corresponding to the closed condition of the helmet. The upwardly extending width of the nape facing section 8 is greater than the width of the jaw facing section 9, 10.

Figure 4:
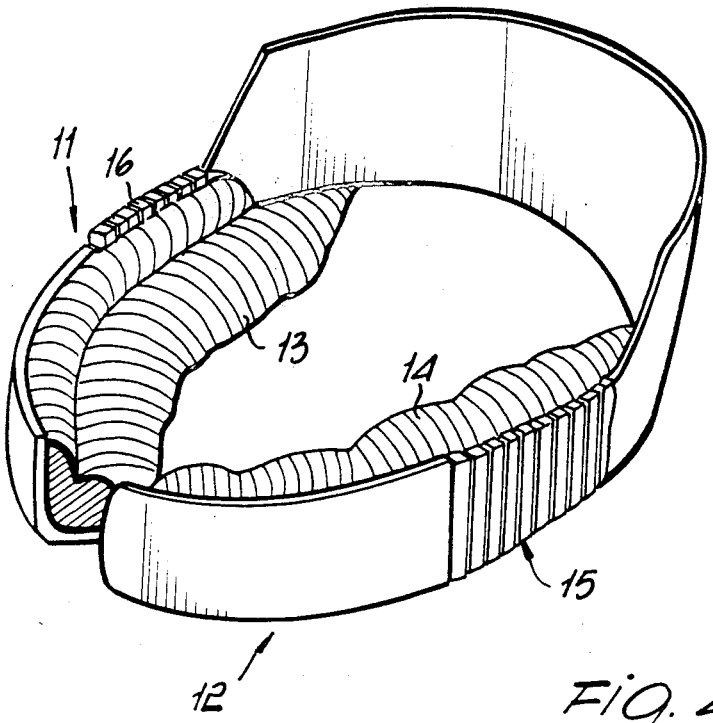
FIG. 4 is a perspective view of the split ring as fitted with a padding.

Said elastic ring 7 forms the core of a ring member which is then provided with paddings 11 and 12, shown in FIG. 4, which also extend over inward regions 13 and 14 and restrict the helmet downward opening to secure it against the user's chin.

The two arcuated appendages or lugs 9 and 10 are provided with front latch means which engage with the element 4 where the lugs are elastically deformed and brought together for closing the helmet.

Figure 5:
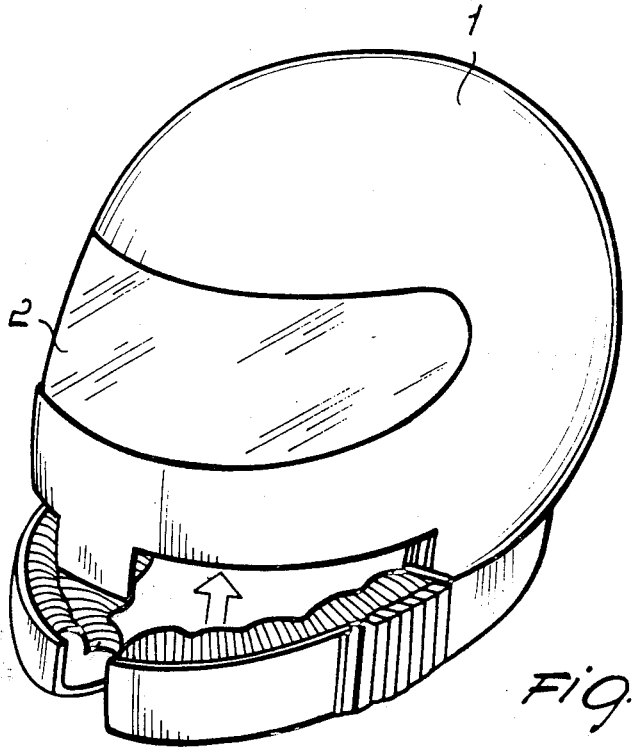
FIG. 5 shows how the padded elastic split ring is attached to the helmet head cap.

During the assembling operations, as shown in FIG. 5, the elastic ring is inserted into the head cap such that the region 8 occupies the region 3 of the cap and is firmly retained thereat due to the L-like shape thereof. Therefore the lugs 9 and 10 will locate at the open areas 6.

Of course, it will be appropriate to provide additional devices for fastening, where necessary, said elastic ring 7 to the cap 1.

Also provided are deformable regions, indicated at 15 and 16, which enable a local deformation of the jaw facing sections 9 and 10 to be promoted.

The elastic ring 7 is bent so that the jaw facing sections 9 and 10 either are normally spread apart or normally closed together.

In the former case, by operating the device binding the ends of the jaw facing sections to the lug 4, the jaw facing sections will automatically snap open and the helmet released.

In the latter case, in order to release the helmet after the front device has been unlocked, the hands shall have to be used to force outwards the jaw facing sections, now in the positions 9*a* and 10*a* of FIG. 3, and produce a sufficient elastic deformation thereof to take the helmet off one's head.

It may be appreciated that with the present crash-helmet all of the hinge devices required heretofore in prior openable crash helmets have been eliminated to permit spreading apart of the helmet lower portion through which the user's head is to be passed.

The split ring may also be differently configured, without impairing its operation and practicality both from the manufacturing and usability standpoints.

It could also be advantageous to provide, instead of a single ring element, two separate pieces which would be individually associated with the rear portion of the head cap, while still using the same principle of an elastic deformation of the members securing the helmet on the user's head.

Figure 6:
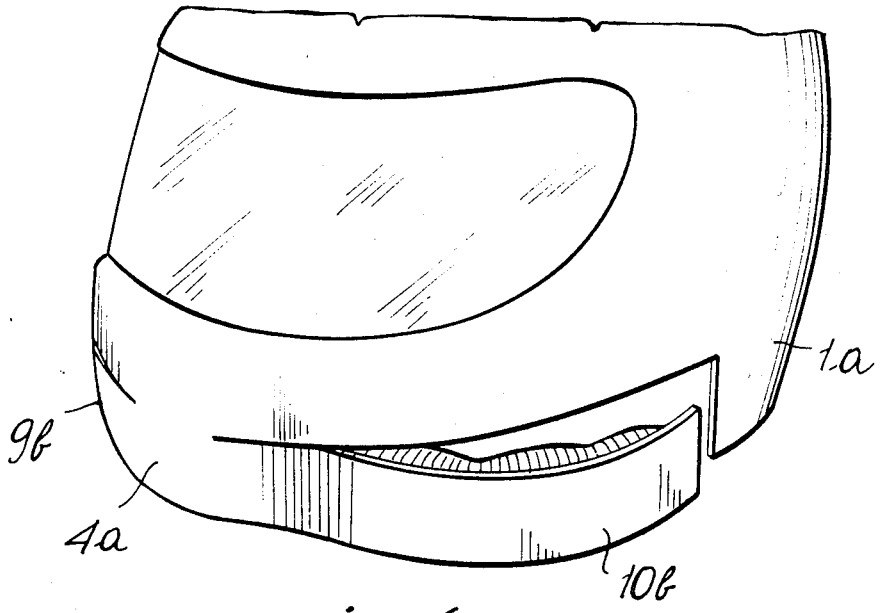
FIG. 6, shows a modified embodiment.
Figure 2:
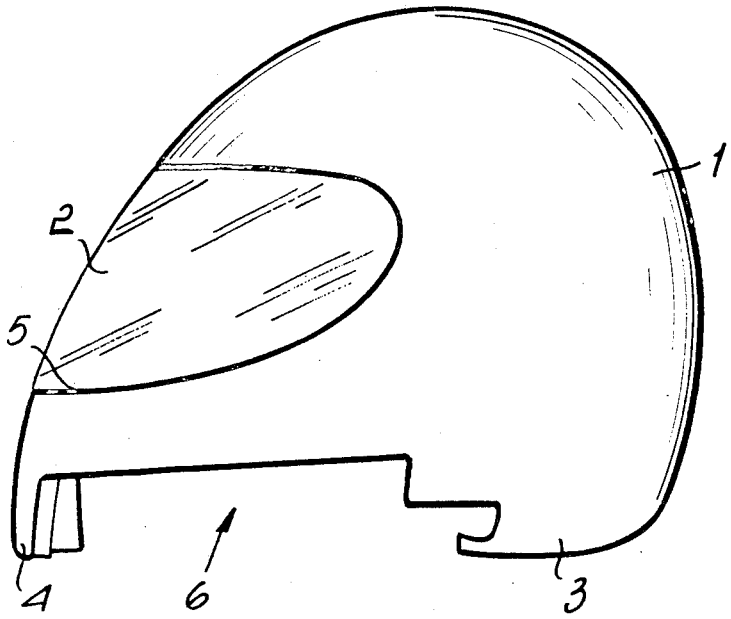
FIG. 2 is a side view of the helmet head cap.

It could be likewise advantageous to arrange the elastic ring such that it is attached to the front of the helmet, as the chin piece area 4*a* thereof, and is spreadable open at the rear, where the free ends of the elastic jaw facing sections 9*b*, 10*b* would engage the helmet shell 1*a* with some latch means as shown in FIG. 6.

The inventive crash helmet is specifically convenient from the manufacturing standpoint in that it affords, in the simplest of cases, the possibility of fabricating just two finished and independent parts which are then associated together easily with a single operation.

The absence of any hinge or swivel devices obviously results in a simpler construction which minimizes the likelihood of malfunction or failure.

By using an elastic split ring configured for a normally spread apart condition, moreover, any spring devices for automatically spreading apart the helmet openable parts may be omitted.

Of course, based on the same inventive idea, many changes and modifications may be made without departing from the scope of this invention.

Furthermore, the materials and dimensions used may be any selected ones to meet individual requirements.

I claim:

1. A crash helmet having a helmet shell with a front base portion, a nape base portion and between the front base portion and the nape base portion a pair of opposite side base portions, said front base portion, said pair of side base portions and said nape base portion defining a base opening of the helmet shell, said opposite side base portions and part of said front base portion being upwardly recessed with respect to said nape base portion, to define opposite side wall recesses in said helmet shell, a resiliently flexible split ring member arranged below and coextensive with said opposite side portions, said nape base portion and part of said front base portion, and having a split adjacent said front base portion, said split ring member having a nape facing section coextensive with said nape base portion and opposite jaw facing sections extending from said nape facing section and ending at said split and coextensive with said opposite side base portions and part of said front base portion, said split ring member having a width dimension in a direction substantially perpendicular to said base opening, said width dimension being greater at said nape facing section thereof as compared to the width dimension thereof at said opposite jaw facing sections, said split ring member having a core in the form of a lamina of resilient material coextensive with said jaw facing sections and said nape facing section thereof, said split ring member having said nape facing section thereof retained in the nape base portion of said helmet shell and wherein said split ring member has at least internal paddings and being resiliently flexible from a closed configuration thereof into an open configuration thereof and viceversa.

2. A helmet according to claim 1, wherein said front base portion has a non recessed intermediate part in the form of a lug arranged between said recesses and wherein said jaw facing sections of said split ring member extend within said recesses and engage with said lug in said closed configuration thereof and wherein said split ring member is spread apart from said lug in said open configuration thereof.

3. A helmet according to claim 2, wherein said jaw facing sections of said split ring member assume normally under non stressed condition and spread apart open configuration thereof, and assume said closed configuration under stressed conditions.

4. A helmet according to claim 2, wherein said jaw facing sections of said split ring member assume normally under non stressed conditions said closed configuration thereof and assume said spread apart open configuration thereof under stressed conditions thereof.

5. A helmet according to claim 2, wherein said nape facing section is an integral part of said nape base portion of the helmet shell.

6. A crash helmet having a helmet shell with a front base portion, a nape base portion and between the front base portion and the nape base portion a pair of opposite side base portions, said front base portion, said pair of side base portions and said nape base portion defining a base opening of the helmet shell, said opposite side base portions and part of said front base portion being upwardly recessed with respect to said nape base portion, to define opposite side wall recesses in said helmet shell, a resiliently flexible split ring member arranged below and coextensive with said opposite side portions and part of said front base portion and having a split adjacent said nape base portion, said split ring member having opposite jaw facing sections extending from said front base portion and ending at said split and coextensive with said opposite side base portions and part of said front base portion, said split ring member having a width dimension in a direction substantially perpendicular to said base opening, said split ring member having a core in the form of a lamina of resilient material coextensive with said jaw facing sections and at least part of said front base portion, said split ring member having said jaw facing section thereof retained in said front base portion of said helmet shell and wherein said split ring member has at least internal paddings and being resiliently flexible from a closed configuration thereof engaging said nape base portion into an open configuration thereof in which said jaw facing sections are spread apart from said nape base portion and viceversa.

* * * * *